US011665480B2

(12) United States Patent
Ren et al.

(10) Patent No.: US 11,665,480 B2
(45) Date of Patent: May 30, 2023

(54) SPEAKER

(71) Applicant: AAC Microtech (Changzhou) Co., Ltd., Changzhou (CN)

(72) Inventors: Zhang Ren, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/563,053

(22) Filed: Dec. 28, 2021

(65) Prior Publication Data

US 2022/0408193 A1 Dec. 22, 2022

(30) Foreign Application Priority Data

Jun. 21, 2021 (CN) ..... 202121379866.X

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01)

(58) Field of Classification Search
CPC ..... H04R 9/025; H04R 7/18; H04R 2400/11
See application file for complete search history.

(56) References Cited

U.S. PATENT DOCUMENTS

2014/0056464 A1* 2/2014 Li ..... H04R 9/025 381/400

* cited by examiner

*Primary Examiner* — Sunita Joshi
(74) *Attorney, Agent, or Firm* — W&G Law Group

(57) ABSTRACT

Provided is a speaker, including a frame; a vibration unit fixed to the frame; and a magnetic circuit unit driving the vibration unit to vibrate and provided with a magnetic gap. The vibration unit includes a diaphragm fixed to the frame and a voice coil inserted in the magnetic gap to drive the diaphragm to vibrate and produce sound; an outer periphery of the diaphragm bends and extends to form at least one fixing portion; and the at least one fixing portion extends along a vibrating direction of the diaphragm and is attached to an inner peripheral side of the frame. With this structure, the bonding strength of the frame and the diaphragm is improved, the diaphragm does not occupy an outer space of the frame, and an appearance size of the speaker is effectively controlled, thereby facilitating the miniaturization design.

9 Claims, 4 Drawing Sheets

A-A

SPEAKER

TECHNICAL FIELD

The present disclosure relates to the field of electro-acoustic conversion, in particular to a speaker for a portable electronic device.

BACKGROUND

As one of the main components of mobile terminals such as mobile phones and headphones, speakers are used to convert electrical signals into sound signals.

In the related art, a speaker includes a frame, a vibration unit fixed to the frame and a magnetic circuit unit provided with a magnetic gap. The vibration unit includes a diaphragm fixed to the frame and a voice coil inserted in the magnetic gap to drive the diaphragm to vibrate and produce sound.

The frame uses a thin steel ring in order to make full use of the internal space. To avoid the integral molding of the frame and the rubber mold and the height of the frame from affecting reliability, a rubber edge is provided on the outer side of the frame to increase the bonding force between the rubber and the frame. However, the diaphragm occupies the space on the outer peripheral side of the frame, resulting in an increase in the size of the outer peripheral side of the speaker, which is not conducive to the miniaturization of the terminal product.

Therefore, it needs to provide a speaker to solve the above technical problem.

SUMMARY

An objective of the present disclosure is to provide a reliable and miniaturized speaker.

An embodiment of the present disclosure provides a speaker, including: a frame; a vibration unit fixed to the frame; and a magnetic circuit unit driving the vibration unit to vibrate and provided with a magnetic gap. The vibration unit includes a diaphragm fixed to the frame and a voice coil inserted in the magnetic gap to drive the diaphragm to vibrate and produce sound; an outer periphery of the diaphragm bends and extends to form at least one fixing portion; and the at least one fixing portion extends along a vibrating direction of the diaphragm and is attached to an inner peripheral side of the frame.

As an improvement, the diaphragm includes a first suspension having a ring shape, a second suspension having a ring shape and a vibrating portion having a ring shape; the first suspension surrounds and is spaced apart from the second suspension; and an outer periphery of the vibrating portion is fixed to a side of the first suspension close to the second suspension, and an inner periphery of the vibrating portion is fixed to a side of the second suspension close to the first suspension; and each of the at least one fixing portion includes a first fixing portion extending from an outer periphery of the first suspension and attached to the inner peripheral side of the frame, and a supporting portion extending from the first fixing portion; and the supporting portion includes a first supporting portion extending from the first fixing portion toward the magnetic circuit unit along the vibrating direction and attached to the inner peripheral side of the frame, and a second supporting portion extending from the first fixing portion in a direction away from the magnetic circuit unit along the vibrating direction and attached to the inner peripheral side of the frame.

As an improvement, the first suspension has a rectangular structure with round corners; and the at least one fixing portion includes two fixing portions, which are located at two opposite sides of the first suspension.

As an improvement, the two fixing portions are located at two short edges of the first suspension; the diaphragm further includes reinforcing portions formed at the round corners; two reinforcing portions of the reinforcing portions located at two ends of one of the two short edges are connected to two opposite ends of one of the fixing portions; and two ends of each of the reinforcing portions along the vibrating direction extend beyond the fixing portions.

As an improvement, upper and lower end surfaces of each of the reinforcing portions along the vibrating direction are lower than upper and lower end surfaces of the frame.

As an improvement, the speaker further includes a front cover covering sides of the reinforcing portions away from the magnetic circuit unit and fixed to an inner side of the frame; the front cover is spaced apart from the diaphragm to form a front chamber, and the front cover is provided with a sound hole, which communicates the front chamber with an exterior.

As an improvement, the frame includes a first frame and a second frame stacked to and fixed to the first frame along the vibrating direction; and the vibration unit is fixed to the second frame, and the magnetic circuit unit is fixed to the first frame.

As an improvement, the frame is made of a metal material.

As an improvement, the vibration unit further includes a holder fixed to the diaphragm, and one end of the holder extends into the magnetic gap to be fixed to and connected to the voice coil.

As an improvement, the magnetic circuit unit includes a yoke fixed in the frame, a first main magnet stacked to a side of the yoke close to the diaphragm, a first pole plate stacked to a side of the first main magnet close to the diaphragm, a second main magnet stacked to a side of the first pole plate close to the diaphragm, at least two auxiliary magnets stacked to a side of the yoke close to the diaphragm and spaced apart from the first main magnet to form the magnetic gap, and a second pole plate stacked to a side of each of the auxiliary magnets close to the diaphragm.

Compared with the related art, the speaker in the present disclosure includes a frame, a vibration unit fixed to the frame and a magnetic circuit unit driving the vibration unit to vibrate and provided with a magnetic gap; the vibration unit includes a diaphragm fixed to the frame and a voice coil inserted in the magnetic gap to drive the diaphragm to vibrate and produce sound; an outer periphery of the diaphragm bends and extends to form fixing portions, the fixing portions extend along a vibrating direction of the diaphragm and are attached to an inner peripheral side of the frame. With this structure, the bonding strength of the frame and the diaphragm is improved; in addition, the diaphragm does not occupy an outer space of the frame, and an appearance size of the speaker is effectively controlled, thereby facilitating the miniaturization design.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

Figure 1:
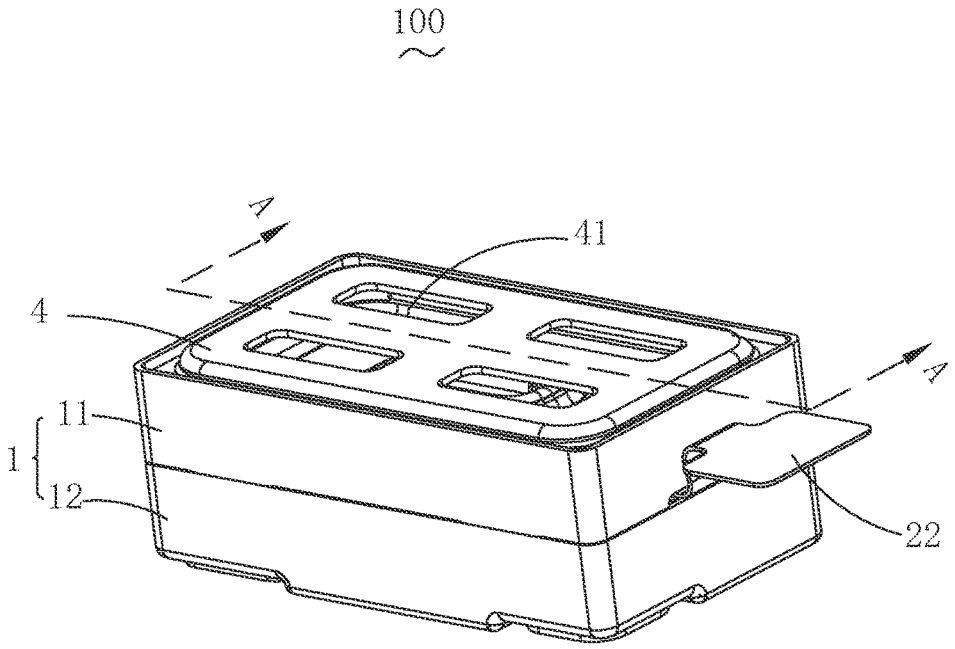
FIG. 1 is a three-dimensional view illustrating a structure of a speaker according to an embodiment of the present disclosure.
Figure 2:
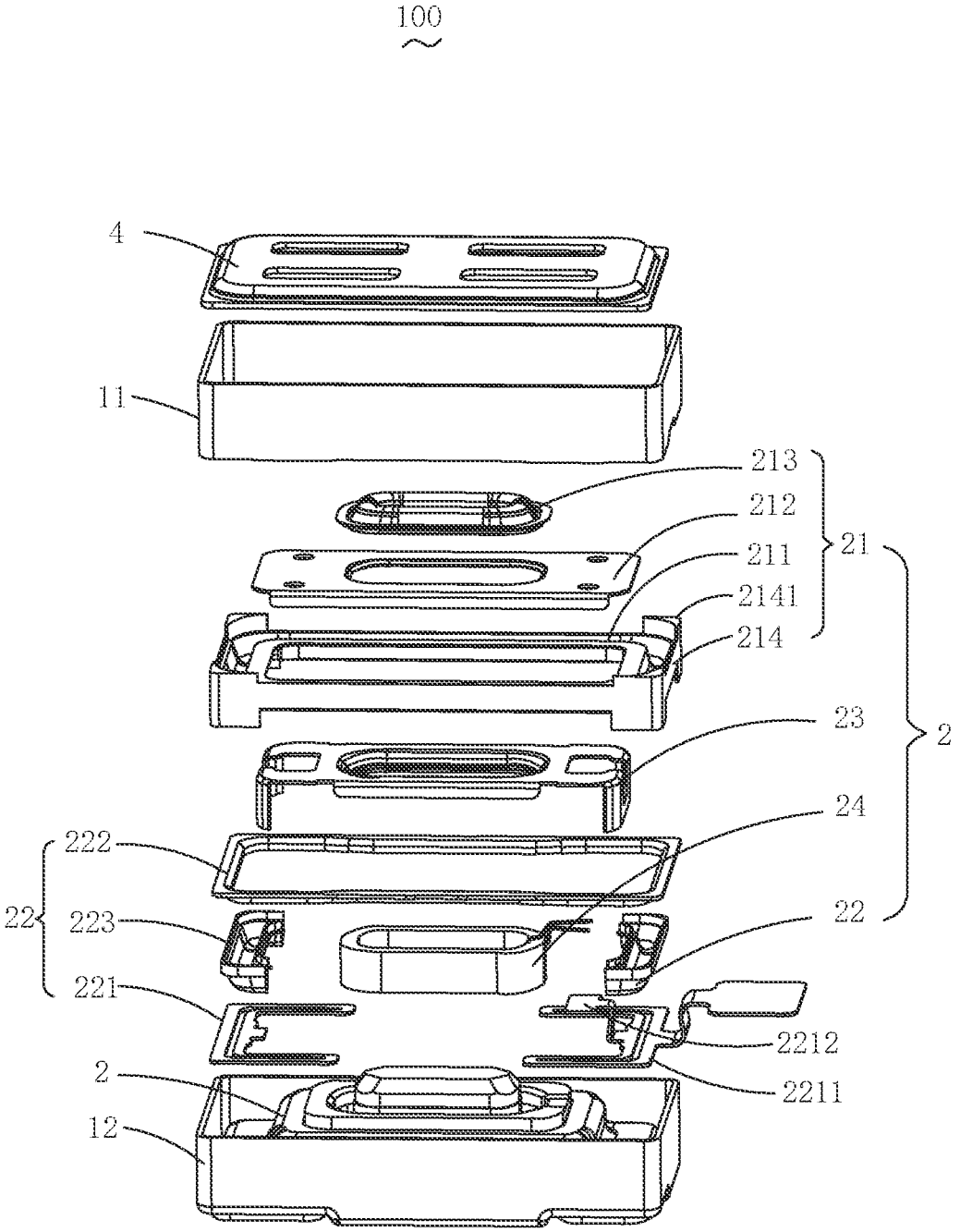
FIG. 2 is an exploded view of a speaker according to an embodiment of the present disclosure.
Figure 3:
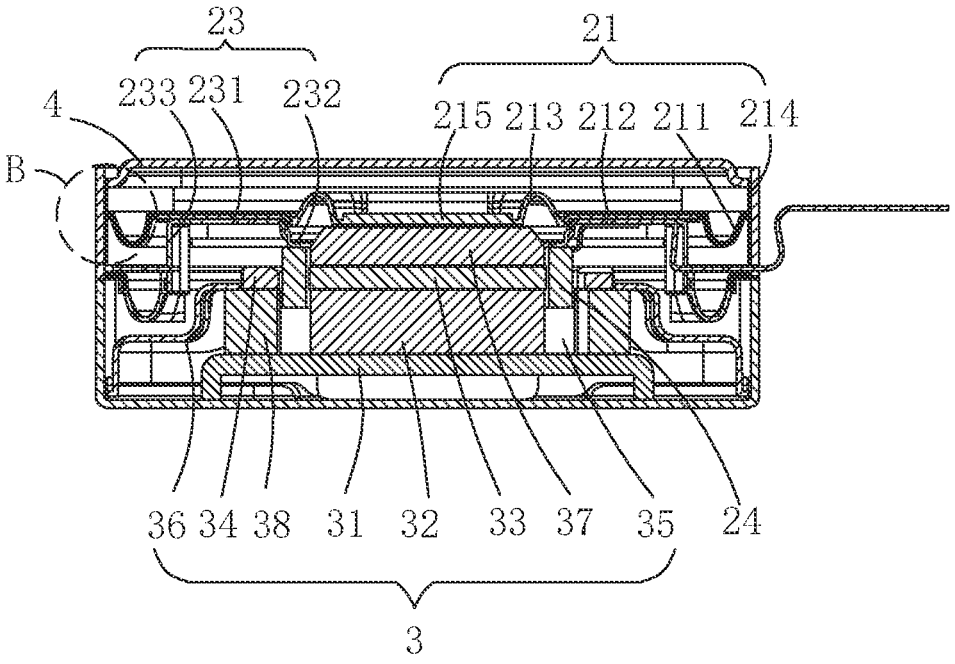
FIG. 3 is a sectional view taken along line A-A shown in FIG. 1.
Figure 4:
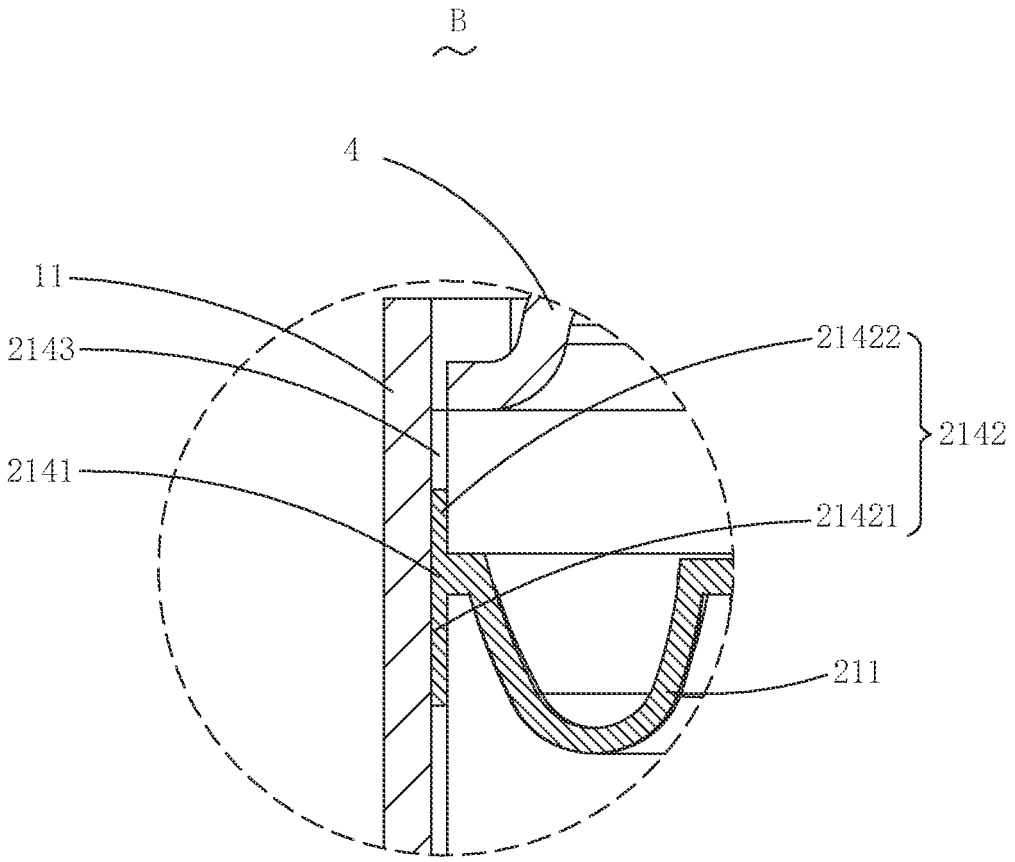
FIG. 4 is an enlarged view of B shown in FIG. 3.

Referring to FIG. 1 to FIG. 4, an embodiment of the present disclosure provides a speaker 100. The speaker 100 includes a frame 1, a vibration unit 2 and a magnetic circuit unit 3.

The magnetic circuit unit 3 is provided with a magnetic gap 35. The vibration unit 2 includes a diaphragm 21 fixed to the frame 1, and a voice coil 24 driving the diaphragm 21 to vibrate and produce sound. The voice coil 24 is inserted in the magnetic gap 35. The magnetic circuit unit 3 drives the voice coil 24 to produce sound, and the acoustic performance of the voice coil 24 is improved through the diaphragm 21.

An outer periphery of the diaphragm 21 bends and extends to form fixing portions 214. The fixing portions 214 extend along a vibrating direction of the diaphragm 21 and are attached to an inner peripheral side of the frame 1. With this structure, the bonding strength of the frame 1 and the diaphragm 21 is improved; in addition, the diaphragm 21 does not occupy an outer space of the frame 1, thereby effectively controlling an appearance size of the speaker 100, and thus facilitating the miniaturization design.

The diaphragm 21 includes a ring-shaped first suspension 211, a ring-shaped second suspension 213 and a ring-shaped vibrating portion 212. The first suspension 211 surrounds and is spaced apart from the second suspension 213. An outer periphery of the vibrating portion 212 is fixed to a side of the first suspension 211 close to the second suspension 213, and an inner periphery of the vibrating portion 212 is fixed to a side of the second suspension 213 close to the first suspension 211. An inner periphery of each of the fixing portions 214 is fixed to an outer periphery of the first suspension 211, and an outer periphery of each of the fixing portions 214 is fixed to the frame 1.

The fixing portions 214 each include a first fixing portion 2141 extending from the outer periphery of the first suspension 211 and attached to the frame 1, and a supporting portion 2142 extending from the first fixing portion 2141. A contact area between the fixing portions 214 and the inner peripheral side of the frame 1 is increased to improve the fixing effect between the diaphragm 21 and the frame 1. By fixing the fixing portions 214 to the inner peripheral side of the frame 1, the mounting space is saved, and the acoustic performance of the speaker is effectively improved.

The supporting portion 2142 includes a first supporting portion 21421 extending from the first fixing portion 2141 toward the magnetic circuit unit 3 along the vibrating direction and attached to the inner peripheral side of the frame 1, and a second supporting portion 21422 extending from the first fixing portion 2141 in a direction away from the magnetic circuit unit 3 along the vibrating direction and attached to the inner peripheral side of the frame 1. The first supporting portion 21421 and the second supporting portion 21422 respectively support the upper and lower sides of the first fixing portion 2141, thereby improving the fixing effect between the diaphragm 21 and the frame 1.

The first suspension 211 has a rectangular structure with round corners. Two fixing portions 214 are provided and arranged at two opposite sides of the first suspension 211.

The two fixing portions 214 are located at two short edges of the first suspension 211. The diaphragm 21 further includes reinforcing portions 2143 formed at the round corners. Two reinforcing portions 2143 located at two ends of a same short edge are connected to two opposite ends of one fixing portion 214. Two ends of the reinforcing portion 2143 along the vibrating direction extend beyond the fixing portion 214.

Upper and lower end surfaces of the reinforcing portion 2143 along the vibrating direction are lower than upper and lower end surfaces of the frame 1. The height of a steel ring is used to store excess rubber extruded during a rubber molding process. The rubber meets the bonding force of the steel ring and does not need to exceed the inner surface of the steel ring, thereby saving space.

Four reinforcing portions 2143 are provided, and the four reinforcing portions 2143 are located at four corners of the inner peripheral side of the frame 1.

The speaker further includes a front cover 4 covering sides of the reinforcing portions 2143 away from the magnetic circuit unit 3 and fixed to an inner side of the frame 1. The front cover 4 is spaced apart from the diaphragm 21 to form a front chamber 5. The front cover 4 is provided with sound holes 41. The sound holes 41 communicate the front chamber 5 with the exterior. Multiple sound holes 41 are provided, and the multiple sound holes 41 are evenly distributed in the front cover 4.

The frame 1 includes a first frame 12 and a second frame 11 stacked to and fixed to the first frame 12 along the vibrating direction. The vibration unit 2 is fixed to the second frame 11, and the magnetic circuit unit 3 is fixed to the first frame 12.

The frame 1 is made of a metal material. The frame 1 has a steel ring structure with high strength and desirable fixing effect.

The vibration unit 2 further includes a dome 215, and the dome 215 covers an inner periphery of the second suspension 213.

In this embodiment, the vibration unit 2 further includes a holder 23 fixed to the diaphragm 21. One end of the holder 23 extends into the magnetic gap 35 to be fixed to and connected to the voice coil 24. The holder 23 includes a ring-shaped holder body 231 and a holder fixing portion 232 bending and extending from an inner peripheral side of the holder body 231 toward the voice coil 24. The holder body 231 is located between the first suspension 211 and the second suspension 213, and is connected to an inner periphery of the first suspension 211 and an outer periphery of the second suspension 213 to serve as the vibrating portion 212.

The holder 23 further includes second fixing portions 233 extending from an outer periphery of the holder body 231 in a direction away from the diaphragm 21. The vibration unit 2 further includes elastic support assemblies 22. The elastic support assemblies 22 are fixed to an end of the frame 1 away from the diaphragm 21. The second fixing portions 233 are connected to the frame 1.

Two elastic support assemblies 22 are provided and located at two opposite sides of the voice coil 24.

The elastic support assemblies 22 each include a conductive elastic member 221, a steel ring 222 fixed to the elastic member 221 and an auxiliary diaphragm 223 fixed to the steel ring 222. The elastic member 221 includes a first elastic arm 2211 attached to a side of the steel ring 222 close to the diaphragm 21, a second elastic arm 2212 fixed to the holder 23 and spaced apart from the first elastic arm 2211, and an elastic connecting arm connecting the first elastic arm 2211 and the second elastic arm 2212. The second elastic arm 2212 is electrically connected to the voice coil 24.

The magnetic circuit unit 3 includes a yoke 31 fixed in the frame 1, a first main magnet 32 stacked to a side of the yoke 31 close to the diaphragm 21, a first pole plate 33 stacked to a side of the first main magnet 32 close to the diaphragm 21, a second main magnet 37 stacked to a side of the first pole plate 33 close to the diaphragm 21, at least two auxiliary magnets 38 stacked to a side of the yoke 31 close to the diaphragm 21 and spaced apart from the first main magnet 32 to form the magnetic gap 35, and a second pole plate 34 stacked to a side of each of the auxiliary magnets 38 close to the diaphragm 21.

The magnetic circuit unit 3 further includes a ring-shaped bracket 36. An outer periphery of the bracket 36 is fixed to the frame 1, and an inner periphery of the bracket 36 is fixed to upper surfaces of the auxiliary magnets 38.

Compared with the related art, the speaker in the present disclosure includes a frame, a vibration unit fixed to the frame and a magnetic circuit unit driving the vibration unit to vibrate and provided with a magnetic gap; the vibration unit includes a diaphragm fixed to the frame and a voice coil inserted in the magnetic gap to drive the diaphragm to vibrate and produce sound; an outer periphery of the diaphragm bends and extends to form fixing portions, the fixing portions extend along a vibrating direction of the diaphragm and are attached to an inner peripheral side of the frame. With this structure, the bonding strength of the frame and the diaphragm is improved; in addition, the diaphragm does not occupy an outer space of the frame, and an appearance size of the speaker is effectively controlled, thereby facilitating the miniaturization design.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame;

a vibration unit fixed to the frame; and a magnetic circuit unit driving the vibration unit to vibrate and provided with a magnetic gap, wherein the vibration unit comprises a diaphragm fixed to the frame and a voice coil inserted in the magnetic gap to drive the diaphragm to vibrate and produce sound; an outer periphery of the diaphragm bends and extends to form at least one fixing portion; and the at least one fixing portion extends along a vibrating direction of the diaphragm and is attached to an inner peripheral side of the frame, the frame comprises a first frame and a second frame stacked to and fixed to the first frame along the vibrating direction, and the vibration unit is fixed to the second frame, and the magnetic circuit unit is fixed to the first frame.

2. The speaker as described in claim 1, wherein the diaphragm comprises a first suspension having a ring shape, a second suspension having a ring shape and a vibrating portion having a ring shape; the first suspension surrounds and is spaced apart from the second suspension; and an outer periphery of the vibrating portion is fixed to a side of the first suspension close to the second suspension, and an inner periphery of the vibrating portion is fixed to a side of the second suspension close to the first suspension; and each of the at least one fixing portion comprises a first fixing portion extending from an outer periphery of the first suspension and attached to the inner peripheral side of the frame, and a supporting portion extending from the first fixing portion; and the supporting portion comprises a first supporting portion extending from the first fixing portion toward the magnetic circuit unit along the vibrating direction and attached to the inner peripheral side of the frame, and a second supporting portion extending from the first fixing portion in a direction away from the magnetic circuit unit along the vibrating direction and attached to the inner peripheral side of the frame.

3. The speaker as described in claim 2, wherein the first suspension has a rectangular structure with round corners; and the at least one fixing portion comprises two fixing portions, which are located at two opposite sides of the first suspension.

4. The speaker as described in claim 3, wherein the two fixing portions are located at two short edges of the first suspension; the diaphragm further comprises reinforcing portions formed at the round corners; two reinforcing portions of the reinforcing portions located at two ends of one of the two short edges are connected to two opposite ends of one of the fixing portions; and two ends of each of the reinforcing portions along the vibrating direction extend beyond the fixing portions.

5. The speaker as described in claim 4, wherein upper and lower end surfaces of each of the reinforcing portions along the vibrating direction are lower than upper and lower end surfaces of the frame.

6. The speaker as described in claim 5, further comprising a front cover covering sides of the reinforcing portions away from the magnetic circuit unit and fixed to an inner side of the frame, wherein the front cover is spaced apart from the diaphragm to form a front chamber, and the front cover is provided with a sound hole, which communicates the front chamber with an exterior.

7. The speaker as described in claim 1, wherein the frame is made of a metal material.

8. The speaker as described in claim 1, wherein the vibration unit further comprises a holder fixed to the diaphragm, and one end of the holder extends into the magnetic gap to be fixed to and connected to the voice coil.

9. The speaker as described in claim 1, wherein the magnetic circuit unit comprises a yoke fixed in the frame, a first main magnet stacked to a side of the yoke close to the diaphragm, a first pole plate stacked to a side of the first main magnet close to the diaphragm, a second main magnet stacked to a side of the first pole plate close to the diaphragm, at least two auxiliary magnets stacked to a side of the yoke close to the diaphragm and spaced apart from the first main magnet to form the magnetic gap, and a second pole plate stacked to a side of each of the auxiliary magnets close to the diaphragm.

* * * * *